US009633666B2

(12) United States Patent
Qi et al.

(10) Patent No.: US 9,633,666 B2
(45) Date of Patent: Apr. 25, 2017

(54) METHOD AND APPARATUS FOR DETECTING CORRECTNESS OF PITCH PERIOD

(71) Applicant: Huawei Technologies Co., Ltd., Shenzhen (CN)

(72) Inventors: Fengyan Qi, Beijing (CN); Lei Miao, Beijing (CN)

(73) Assignee: HUAWEI TECHNOLOGIES, CO., LTD., Shenzhen (CN)

( * ) Notice: Subject to any disclaimer, the term of this patent is extended or adjusted under 35 U.S.C. 154(b) by 212 days.

(21) Appl. No.: 14/543,320

(22) Filed: Nov. 17, 2014

(65) Prior Publication Data

US 2015/0073781 A1 Mar. 12, 2015

Related U.S. Application Data

(63) Continuation of application No. PCT/CN2012/087512, filed on Dec. 26, 2012.

(30) Foreign Application Priority Data

May 18, 2012 (CN) ..... 2012 1 0155298

(51) Int. Cl.
*G10L 19/00* (2013.01)
*G10L 21/00* (2013.01)
(Continued)

(52) U.S. Cl.
CPC ..... *G10L 21/013* (2013.01); *G10L 19/00* (2013.01); *G10L 21/028* (2013.01); *G10L 25/00* (2013.01); *G10L 25/90* (2013.01)

(58) Field of Classification Search
None
See application file for complete search history.

(56) References Cited

U.S. PATENT DOCUMENTS 4,776,014 A * 10/1988 Zinser, Jr. ..... G10L 19/08 704/262
4,791,671 A 12/1988 Willems
(Continued)

FOREIGN PATENT DOCUMENTS

CN 1473322 A 2/2004
CN 101149924 A 3/2008
(Continued)

OTHER PUBLICATIONS

Partial English Translation and Abstract of Japanese Patent Application No. JPH10-124094, Mar. 18, 2016, 52 pages.
(Continued)

*Primary Examiner* — Pierre-Louis Desir
*Assistant Examiner* — David Kovacek
(74) *Attorney, Agent, or Firm* — Conley Rose, P.C.

(57) ABSTRACT

A method and an apparatus for detecting correctness of a pitch period. The method for detecting correctness of a pitch period includes determining, according to an initial pitch period of an input signal in a time domain, a pitch frequency bin of the input signal, where the initial pitch period is obtained by performing open-loop detection on the input signal; determining, based on an amplitude spectrum of the input signal in a frequency domain, a pitch period correctness decision parameter, associated with the pitch frequency bin, of the input signal; and determining correctness of the initial pitch period according to the pitch period correctness decision parameter. The method and apparatus for detecting correctness of a pitch period according to the embodiments of the present invention can improve, based on a relatively less complex algorithm, accuracy of detecting correctness of a pitch period.

15 Claims, 3 Drawing Sheets

(51) Int. Cl.

| | |
|---|---|
| ***G10L 25/00*** | (2013.01) |
| ***G10L 21/013*** | (2013.01) |
| ***G10L 21/028*** | (2013.01) |
| ***G10L 25/90*** | (2013.01) |

(56) References Cited

U.S. PATENT DOCUMENTS 4,885,790 A * 12/1989 McAulay ..... G10L 19/02 704/261
5,027,404 A * 6/1991 Taguchi ..... G10L 19/07 704/221
5,054,072 A * 10/1991 McAulay ..... G10L 19/02 704/207
5,729,694 A * 3/1998 Holzrichter ..... G10L 15/24 704/270
5,774,837 A * 6/1998 Yeldener ..... G10L 19/18 704/206
5,778,334 A * 7/1998 Ozawa ..... G10L 19/08 704/214
5,832,437 A 11/1998 Nishiguchi et al.
6,012,023 A * 1/2000 Iijima ..... G10L 25/90 704/207
6,014,622 A * 1/2000 Su ..... G10L 19/08 704/207
6,108,621 A 8/2000 Nishiguchi et al.
6,151,571 A * 11/2000 Pertrushin ..... G10L 17/26 704/207
6,188,980 B1 * 2/2001 Thyssen ..... G10L 19/005 704/230
6,496,797 B1 12/2002 Redkov et al.
6,535,847 B1 * 3/2003 Marston ..... G10L 19/097 704/208
2001/0001853 A1 * 5/2001 Mauro ..... G10L 21/02 704/233
2001/0044722 A1 * 11/2001 Gustafsson ..... G10L 21/038 704/258
2003/0023430 A1 * 1/2003 Wang ..... G10L 19/26 704/226
2003/0074192 A1 * 4/2003 Choi ..... G10L 19/04 704/219
2003/0086585 A1 * 5/2003 Rhoads ..... G06F 17/30876 382/100
2004/0030546 A1 2/2004 Sato
2004/0128130 A1 * 7/2004 Rose ..... G10L 15/02 704/236
2004/0133424 A1 * 7/2004 Ealey ..... G10L 25/90 704/233
2004/0158462 A1 8/2004 Rutledge et al.
2005/0177364 A1 * 8/2005 Jelinek ..... G10L 19/24 704/214
2009/0076808 A1 * 3/2009 Xu ..... G10L 19/005 704/207
2009/0254340 A1 * 10/2009 Sun ..... G10L 21/0208 704/226
2009/0281805 A1 * 11/2009 LeBlanc ..... G10L 21/0208 704/233
2009/0287496 A1 * 11/2009 Thyssen ..... H03G 7/007 704/500
2009/0319263 A1 * 12/2009 Gupta ..... G10L 19/10 704/229
2010/0070270 A1 * 3/2010 Gao ..... G10H 1/0041 704/207
2010/0211384 A1 * 8/2010 Qi ..... G10L 25/90 704/207
2010/0286805 A1 * 11/2010 Gao ..... G10L 19/0017 700/94
2011/0313777 A1 * 12/2011 Baeckstroem ..... G10L 25/90 704/500
2013/0166288 A1 * 6/2013 Gao ..... G10L 25/90 704/207
2014/0019125 A1 * 1/2014 Laaksonen ..... G10L 21/038 704/205
2014/0142931 A1 * 5/2014 Qi ..... G10L 19/02 704/207
2015/0073781 A1 * 3/2015 Qi ..... G10L 21/013 704/207
2015/0235653 A1 * 8/2015 Liu ..... G10L 21/0388 704/500
2016/0086613 A1 * 3/2016 Liu ..... G10L 19/0204 704/500
2016/0196829 A1 * 7/2016 Liu ..... G10L 21/038 704/500

FOREIGN PATENT DOCUMENTS

| | | | |
|---|---|---|---|
| CN | 101354889 | A | 1/2009 |
| CN | 101556795 | A | 10/2009 |
| CN | 101814291 | A | 8/2010 |
| CN | 102231274 | A | 11/2011 |
| EP | 0837453 | A2 | 4/1998 |
| EP | 1587061 | A1 | 10/2005 |
| JP | H10124094 | A | 5/1998 |

OTHER PUBLICATIONS

Foreign Communication From a Counterpart Application, Japanese Application No. 2015-511902, Japanese Office Action dated Jan. 5, 2016, 3 pages.
Foreign Communication From a Counterpart Application, Japanese Application No. 2015-511902, English Translation of Japanese Office Action dated Jan. 5, 2016, 3 pages.
Foreign Communication From a Counterpart Application, European Application No. 12876916.3, Extended European Search Report dated Jun. 11, 2015, 9 pages.
Partial English Translation and Abstract of Chinese Patent Application No. CN101556795A, Feb. 15, 2015, 24 pages.
"General Aspects of Digital Transmission Systems, Coding of Speech at 8 kbit/s Using Conjugate-Structure Algebraic-Code-Excited Linear-Prediction (CS-ACELP)," ITU-T, G.729, Mar. 1996, 39 pages.
Foreign Communication From a Counterpart Application, PCT Application No. PCT/CN2012/087512, English Translation of International Search Report dated Mar. 28, 2013, 5 pages.
Foreign Communication From a Counterpart Application, PCT Application No. PCT/CN2012/087512, English Translation of Written Opinion dated Mar. 28, 2013, 6 pages.

* cited by examiner

METHOD AND APPARATUS FOR DETECTING CORRECTNESS OF PITCH PERIOD

CROSS-REFERENCE TO RELATED APPLICATIONS

This application is a continuation of International Application No. PCT/CN2012/087512, filed on Dec. 26, 2012, which claims priority to Chinese Patent Application No. 201210155298.4, filed on May 18, 2012, both of which are hereby incorporated by reference in their entireties.

TECHNICAL FIELD

The present invention relates to the field of audio technologies, and more specifically, to a method and an apparatus for detecting correctness of a pitch period.

BACKGROUND

In processing speech and audio signals, pitch detection is one of key technologies in various actual speech and audio applications. For example, the pitch detection is the key technology in applications of speech encoding, speech recognition, karaoke, and the like. Pitch detection technologies are widely applied to various electronic devices, such as, a mobile phone, a wireless apparatus, a personal digital assistant (PDA), a handheld or portable computer, a global positioning system (GPS) receiver/navigator, a camera, an audio/video player, a video camera, a video recorder, and a surveillance device. Therefore, accuracy and detection efficiency of the pitch detection directly affect the effect of various actual speech and audio applications.

Current pitch detection is basically performed in a time domain, and generally, a pitch detection algorithm is a time domain autocorrelation method. However, in actual applications, pitch detection performed in the time domain often leads to a frequency multiplication phenomenon, and it is hard to desirably solve the frequency multiplication phenomenon in the time domain, because large autocorrelation coefficients are obtained both for a real pitch period and a multiplied frequency of the real pitch period, and in addition, in a case with background noise, an initial pitch period obtained by open-loop detection in the time domain may also be inaccurate. Here, a real pitch period is an actual pitch period in speech, that is, a correct pitch period. A pitch period refers to a minimum repeatable time interval in speech.

Detecting an initial pitch period in a time domain is used as an example, Most speech encoding standards of the International Telecommunication Union Telecommunication Standardization Sector (ITU-T) require pitch detection to be performed, but almost all of the pitch detection is performed in a same domain (a time domain or a frequency domain). For example, an open-loop pitch detection method performed only in a perceptual weighted domain is applied in the speech encoding standard G729.

In this open-loop pitch detection method, after an initial pitch period is obtained by open-loop detection in the time domain, correctness of the initial pitch period is not performed, but close-loop fine detection is directly performed on the initial pitch period. The close-loop fine detection is performed in a period interval including the initial pitch period obtained by the open-loop detection, so that if the initial pitch period obtained by the open-loop detection is incorrect, a pitch period obtained by the final close-loop fine detection is also incorrect. In other words, because it is extremely hard to ensure that the initial pitch period obtained by the open-loop detection in the time domain is absolutely correct, if an incorrect initial pitch period is applied to the following processing, final audio quality may deteriorate.

In addition, in the prior art, it is also proposed to change the pitch period detection performed in the time domain to pitch period fine detection performed in the frequency domain, but the pitch period fine detection performed in the frequency domain is extremely complex. In the fine detection, further pitch detection may be performed on an input signal in the time domain or the frequency domain according to the initial pitch period, including short-pitch detection, fractional pitch detection, or multiplied frequency pitch detection.

SUMMARY

Embodiments of the present invention provide a method and an apparatus for detecting correctness of a pitch period, so as to solve a problem in the prior art that when correctness of an initial pitch period is detected in a time domain or a frequency domain, accuracy is low and complexity is relatively high.

According to one aspect, a method for detecting correctness of a pitch period is provided, including determining, according to an initial pitch period of an input signal in a time domain, a pitch frequency bin of the input signal, where the initial pitch period is obtained by performing open-loop detection on the input signal; determining, based on an amplitude spectrum of the input signal in a frequency domain, a pitch period correctness decision parameter, associated with the pitch frequency bin, of the input signal; and determining correctness of the initial pitch period according to the pitch period correctness decision parameter.

According to another aspect, an apparatus for detecting correctness of a pitch period is provided, including a pitch frequency bin determining unit configured to determine, according to an initial pitch period of an input signal in a time domain, a pitch frequency bin of the input signal, where the initial pitch period is obtained by performing open-loop detection on the input signal; a parameter generating unit configured to determine, based on an amplitude spectrum of the input signal in a frequency domain, a pitch period correctness decision parameter, associated with the pitch frequency bin, of the input signal; and a correctness determining unit configured to determine correctness of the initial pitch period according to the pitch period correctness decision parameter.

The method and apparatus for detecting correctness of a pitch period according to the embodiments of the present invention can improve, based on a relatively less complex algorithm, accuracy of detecting correctness of a pitch period.

BRIEF DESCRIPTION OF DRAWINGS

To describe the technical solutions in the embodiments of the present invention more clearly, the following briefly introduces the accompanying drawings required for describing the embodiments. The accompanying drawings in the following description show merely some embodiments of the present invention, and a person of ordinary skill in the art may still derive other drawings from these accompanying drawings without creative efforts.

DESCRIPTION OF EMBODIMENTS

The following clearly describes the technical solutions in embodiments of the present invention with reference to the accompanying drawings in the embodiments of the present invention. The described embodiments are a part rather than all of the embodiments of the present invention. All other embodiments obtained by a person of ordinary skill in the art based on the embodiments of the present invention without creative efforts shall fall within the protection scope of the present invention.

According to the embodiments of the present invention, correctness of an initial pitch period obtained by open-loop detection in a time domain is detected in a frequency domain, so as to avoid applying an incorrect initial pitch period to the following processing.

An objective of the embodiments of the present invention is to perform further correctness detection on an initial pitch period, which is obtained by open-loop detection in the time domain, so as to greatly improve accuracy and stability of pitch detection by extracting effective parameters in the frequency domain and making a decision by combining these parameters.

Figure 1:
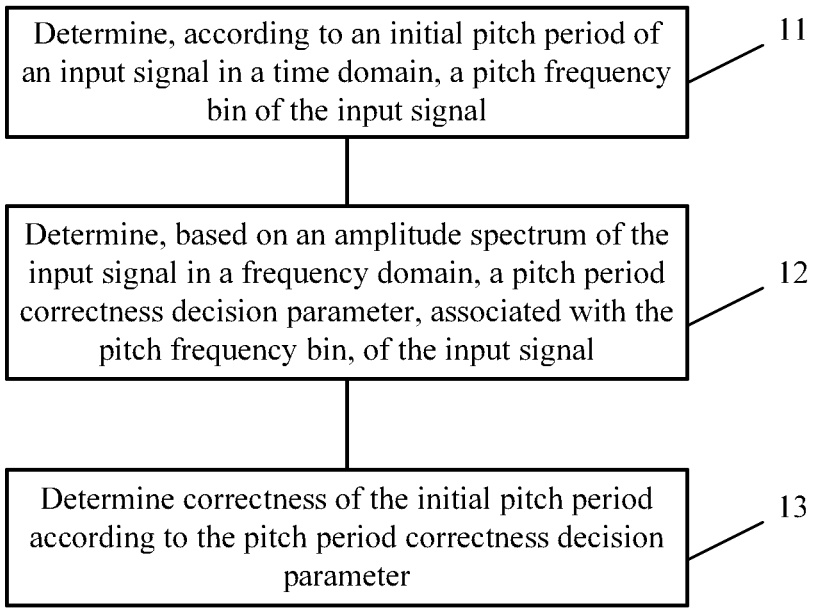
FIG. 1 is a flowchart of a method for detecting correctness of a pitch period according to an embodiment of the present invention.

A method for detecting correctness of a pitch period according to an embodiment of the present invention, as shown in FIG. 1, includes the following steps.

11. Determine, according to an initial pitch period of an input signal in a time domain, a pitch frequency bin of the input signal, where the initial pitch period is obtained by performing open-loop detection on the input signal.

Generally, the pitch frequency bin of the input signal is reversely proportional to the initial pitch period of the input signal, and is directly proportional to a quantity of points of a fast Fourier transform (FFT) performed on the input signal.

12. Determine, based on an amplitude spectrum of the input signal in a frequency domain, a pitch period correctness decision parameter, associated with the pitch frequency bin, of the input signal.

The pitch period correctness decision parameter includes a spectral difference parameter Diff_sm, an average spectral amplitude parameter Spec_sm, and a difference-to-amplitude ratio parameter Diff_ratio. The spectral difference parameter Diff_sm is a sum Diff_sum of spectral differences of a predetermined quantity of frequency bins on two sides of the pitch frequency bin or a weighted and smoothed value of the sum Diff_sum of the spectral differences of the predetermined quantity of frequency bins on the two sides of the pitch frequency bin. The average spectral amplitude parameter Spec_sm is an average Spec_avg of spectral amplitudes of the predetermined quantity of frequency bins on the two sides of the pitch frequency bin or a weighted and smoothed value of the average Spec_avg of the spectral amplitudes of the predetermined quantity of frequency bins on the two sides of the pitch frequency bin. The difference-to-amplitude ratio parameter Diff_ratio is a ratio of the sum Diff_sum of the spectral differences of the predetermined quantity of frequency bins on the two sides of the pitch frequency bin to the average Spec_avg of the spectral amplitudes of the predetermined quantity of frequency bins on the two sides of the pitch frequency bin.

13. Determine correctness of the initial pitch period according to the pitch period correctness decision parameter.

For example, when the pitch period correctness decision parameter meets a correctness determining condition, it is determined that the initial pitch period is correct; and when the pitch period correctness decision parameter meets an incorrectness determining condition, it is determined that the initial pitch period is incorrect.

The incorrectness determining condition meets at least one of the following: the spectral difference parameter Diff_sm is less than a first difference parameter threshold, the average spectral amplitude parameter Spec_sm is less than a first spectral amplitude parameter threshold, and the difference-to-amplitude ratio parameter Diff_ratio is less than a first ratio factor parameter threshold. The correctness determining condition meets at least one of the following: the spectral difference parameter Diff_sm is greater than a second difference parameter threshold, the average spectral amplitude parameter Spec_sm is greater than a second spectral amplitude parameter threshold, and the difference-to-amplitude ratio parameter Diff_ratio is greater than a second ratio factor parameter threshold.

For example, in a case in which the incorrectness determining condition is that the spectral difference parameter Diff_sm is less than the first difference parameter threshold and the correctness determining condition is that the spectral difference parameter Diff_sm is greater than the second difference parameter threshold, the second difference parameter threshold is greater than the first difference parameter threshold. Alternatively, in a case in which the incorrectness determining condition is that the average spectral amplitude parameter Spec_sm is less than the first spectral amplitude parameter threshold and the correctness determining condition is that the average spectral amplitude parameter Spec_sm is greater than the second spectral amplitude parameter threshold, the second spectral amplitude parameter threshold is greater than the first spectral amplitude parameter threshold. Alternatively, in a case in which the incorrectness determining condition is that the difference-to-amplitude ratio parameter Diff_ratio is less than the first ratio factor parameter threshold and the correctness determining condition is that the difference-to-amplitude ratio parameter Diff_ratio is greater than the second ratio factor parameter threshold, the second ratio factor parameter threshold is greater than the first ratio factor parameter threshold.

Generally, if the initial pitch period detected in the time domain is correct, there must be a peak in a frequency bin corresponding to the initial pitch period, and energy is great; and if the initial pitch period detected in the time domain is incorrect, then, fine detection may be further performed in the frequency domain so as to determine a correct pitch period.

In other words, when it is detected that the initial pitch period is incorrect during the detecting, according to the pitch period correctness decision parameter, the correctness of the initial pitch period, the fine detection is performed on the initial pitch period.

Alternatively, when it is detected that the initial pitch period is incorrect during the detecting, according to the pitch period correctness decision parameter, the correctness of the initial pitch period, energy of the initial pitch period is detected in a low-frequency range; and short-pitch detection (a manner of fine detection) is performed when the energy meets a low-frequency energy determining condition.

Therefore, it can be learned that the method for detecting correctness of a pitch period according to this embodiment of the present invention can improve, based on a relatively less complex algorithm, accuracy of detecting correctness of a pitch period.

The following describes in detail a specific embodiment, which includes the following steps.

1. Perform an N-point FFT on an input signal S(n), so as to convert an input signal in a time domain to an input signal in a frequency domain to obtain a corresponding amplitude spectrum S(k) in the frequency domain, where N=256, 512, or the like.

The amplitude spectrum S(k) may be obtained in the following steps:

Step A1. Preprocess the input signal S(n) to obtain a preprocessed input signal $S_{pre}(n)$, where the preprocessing may be processing such as high-pass filtering, re-sampling, or pre-weighting. Only the pre-weighting processing is described herein using an example. The preprocessed input signal $S_{pre}(n)$ is obtained after the input signal S(n) passes a first order high-pass filter, where the high-pass filter has a filter factor $H_{pre\text{-}emph}(z)=1-0.68z^{-1}$.

Step A2. Perform an FFT on the preprocessed input signal $S_{pre}(n)$. In an embodiment, the FFT is performed on the preprocessed input signal $S_{pre}(n)$ twice, where one is to perform the FFT on a preprocessed input signal of a current frame, and the other is to perform the FFT on a preprocessed input signal that includes a second half of the current frame and a first half of a future frame. Before the FFT is performed, the preprocessed input signal needs to be processed by windowing, where a window function is:

$$W_{FFT}(n) = \sqrt{0.5 - 0.5\cos\left(\frac{2\pi n}{L_{FFT}}\right)} = \sin\left(\frac{\pi n}{L_{FFT}}\right),$$

$$n = 0, \ldots, L_{FFT} - 1.$$

$L_{FFT}$ is a length of the FFT.

A windowed signal after a first analyzing window and a second analyzing window are added to the preprocessed input signal is:

$$s^{[0]}_{wnd}(n)=w_{FFT}(n)s_{pre}(n),\ n=0, \ldots, L_{FFT}-1,$$

$$s^{[1]}_{wnd}(n)=w_{FFT}(n)s_{pre}(n+L_{FFT}/2),\ n=0, \ldots, L_{FFT}-1,$$

where, the first analyzing window corresponds to the current frame, and the second analyzing window corresponds to the second half of the current frame and the first half of the future frame.

The FFT is performed on the windowed signal to obtain a spectral coefficient:

$$X^{[0]}(k) = \sum_{n=0}^{N-1} s^{[0]}_{wnd}(n)e^{-j2\pi\frac{kn}{N}},$$

$$k = 0, \ldots, K-1, N = L_{FFT}$$

-continued $$X^{[1]}(k) = \sum_{n=0}^{N-1} s^{[1]}_{wnd}(n)e^{-j2\pi\frac{kn}{N}},$$

$$k = 0, \ldots, K-1, N = L_{FFT},$$

where $K \le L_{FFT}/2$.

The first half of the future frame is from a next frame (look-ahead) signal that is encoded in the time domain, and the input signal may be adjusted according to a quantity of next frame signals. A purpose of performing the FFT twice is to obtain more precise frequency domain information. In another embodiment, the FFT may also be performed on the preprocessed input signal $S_{pre}(n)$ once.

Step A3. Calculate, based on the spectral coefficient, an energy spectrum.

$$E(0)=\eta(X_R^2(0)+X_R^2(L_{FFT}/2)),$$

$$E(k)=\eta(X_R^2(k)+X_I^2(k)),\ k=1, \ldots, K-1,$$

where $X_R(k)$ and $X_I(k)$ denote a real part and an imaginary part of a $k^{th}$ frequency bin respectively; and η is a constant which may be, for example, $4/(L_{FFT}*L_{FFT})$.

Step A4. Perform weighting processing on the energy spectrum.

$$\tilde{E}(k)=\alpha E^{[0]}(k)+(1-\alpha)E^{[1]}(k),\ k=0, \ldots, K-1,\ \alpha\le 1$$

Herein, $E^{[0]}(k)$ is an energy spectrum, calculated according to the formula in step A3, of the spectral coefficient $X^{[0]}(k)$, and $E^{[1]}(k)$ is an energy spectrum, calculated according to the formula in step A3, of the spectral coefficient $X^{[1]}(k)$.

Step A5. Calculate an amplitude spectrum of a logarithm domain.

$$S(k)=\theta \log_{10}(\sqrt{\epsilon+\tilde{E}(k)}),\ k=0, \ldots, K-1,$$

where θ is a constant which may be, for example, 2; and ϵ is a relatively small positive number to prevent a logarithm value from overflowing. Alternatively, $\log_{10}$ may be replaced by $\log_e$ in a project implementation.

2. Perform open-loop detection on the input signal in the time domain to obtain an initial pitch period $T_{op}$, steps of which are as follows:

Step B1. Convert the input signal S(n) to a perceptual weighted signal:

$$sw(n) = s(n) + \sum_{i=1}^{p} a_i\gamma_1^i s(n-i) - \sum_{i=1}^{p} a_i\gamma_2^i sw(n-i)$$

$$n = 0, \ldots, N-1,$$

where $a_i$ is a linear prediction (LP) coefficient, $\gamma_1$ and $\gamma_2$ are perceptual weighting factors, p is an order of a perceptual filter, and N is a frame length.

Step B2. Search for a greatest value in each of three candidate detection ranges (for example, in a lower sampling domain, the three candidate detection ranges may be [62 115]; [32 61]; and [17 31]) using a correlation function, and use the greatest values as candidate pitches:

$$R(k) = \sum_{n=0}^{N-1} sw(n)sw(n-k)$$

where k is a value in a candidate detection range of a pitch period, for example, k may be a value in the three candidate detection ranges.

Step B3. Separately calculate normalized correlation coefficients of the three candidate pitches:

$$R'(t_i) = \frac{R(t_i)}{\sqrt{\sum_n sw^2(n - t_i)}}$$

$$i = 1, \ldots, 3$$

Step B4. Select an open-loop initial pitch period $T_{op}$ by comparing the normalized correlation coefficients of the ranges. Firstly, a period of a first candidate pitch is used as an initial pitch period. Then, if a normalized correlation coefficient of a second candidate pitch is greater than or equal to a product of a normalized correlation coefficient of the initial pitch period and a fixed ratio factor, a period of the second candidate is used as the initial pitch period; otherwise, the initial pitch period does not change. Finally, if a normalized correlation coefficient of a third candidate pitch is greater than or equal to a product of the normalized correlation coefficient of the initial pitch period and the fixed ratio factor, a period of the third candidate is used as the initial pitch period; otherwise, the initial pitch period does not change. Refer to the following program expression:

```
T_op = t_1
R'(T_op)= R'(t_1)
if R'(t_2)≥0.85 R'(T_op)
    R'(T_op)= R'(t_2)
    T_op = t_2
end
if R'(t_3)≥0.85 R'(T_op)
    R'(T_op)= R'(t_3)
    T_op = t_3
end
```

It can be understood that, no limitation is imposed on a sequence of the foregoing steps of obtaining the amplitude spectrum S(k) and the initial pitch period $T_{op}$. The steps may be performed at the same time, or any step may be performed first.

3. Obtain a pitch frequency bin F_op according to a quantity N of points of the FFT and the initial pitch period T_op. F_op=N/$T_{op}$ 4. Calculate a sum Spec_sum of spectral amplitudes and a sum Diff_sum of spectral amplitude differences of a predetermined quantity of frequency bins on two sides of the pitch frequency bin F_op, where the quantity of frequency bins on the two sides of the pitch frequency bin F_op may be preset.

Herein, the sum Spec_sum of the spectral amplitudes is a sum of the spectral amplitudes of the predetermined quantity of frequency bins on the two sides of the pitch frequency bin, and the sum Diff_sum of spectral amplitude differences is a sum of spectral differences of the predetermined quantity of frequency bins on the two sides of the pitch frequency bin, where spectral differences refer to differences between spectral amplitudes of the predetermined quantity of frequency bins on the two sides of the pitch frequency bin F_op and a spectral amplitude of the pitch frequency bin. The sum Spec_sum of spectral amplitudes and the sum Diff_sum of spectral amplitude differences may be expressed in the following program expression: Spec_sum[0]=0; Diff_sum[0]=0; for (i=1; i<2*F_op; i++) {Spec_sum[i]=Spec_sum[i−1]+S[i]; Diff_sum[i]=Diff_sum[i−1]+(S[F_op]−S[i]);}, where i is a sequence number of a frequency bin. In a project implementation, an initial value of i may be set to 2, so as to avoid low-frequency interference of a lowest coefficient.

5. Determine an average spectral amplitude parameter Spec_sm, a spectral difference parameter Diff_sm, and a difference-to-amplitude ratio parameter Diff_ratio.

The average spectral amplitude parameter Spec_sm may be an average spectral amplitude Spec_avg of the predetermined quantity of frequency bins on the two sides of the pitch frequency bin F_op, that is, the sum Spec_sum of spectral amplitudes divided by the quantity of all frequency bins of the predetermined quantity of frequency bins on the two sides of the pitch frequency bin F_op: Spec_avg=Spec_sum/(2*F_op−1).

Further, the average spectral amplitude parameter Spec_sm may also be a weighted and smoothed value of the average spectral amplitude Spec_avg of the predetermined quantity of frequency bins on the two sides of the pitch frequency bin F_op:

Spec_sm=0.2*Spec_sm_pre+0.8*Spec_avg, where Spec_sm_pre is a parameter being a weighted and smoothed value of an average spectral amplitude of a previous frame. In this case, 0.2 and 0.8 are weighting and smoothing coefficients. Different weighting and smoothing coefficients may be selected according to different features of input signals.

The spectral difference parameter Diff_sm may be a sum Diff_sum of spectral amplitude differences or a weighted and smoothed value of the sum Diff_sum of spectral amplitude differences:

Diff_sm=0.4*Diff_sm_pre+0.6*Diff_sum, where Diff_sm_pre is a parameter being a weighted and smoothed value of a spectral difference of a previous frame. Here, 0.4 and 0.6 are weighting and smoothing coefficients. Different weighting and smoothing coefficients may be selected according to different features of input signals.

As can be learned from the above, generally, a weighted and smoothed value Spec_sm of an average spectral amplitude parameter of a current frame is determined based on a weighted and smoothed value Spec_sm_pre of an average spectral amplitude parameter of a previous frame, and a weighted and smoothed value Diff_sm of a spectral difference parameter of the current frame is determined based on a weighted and smoothed value Diff_sm_pre of a spectral difference parameter of the previous frame.

The difference-to-amplitude ratio parameter Diff_ratio is a ratio of the sum Diff_sum of spectral amplitude differences to the average spectral amplitude Spec_avg. Diff_ratio=Diff_sum/Spec_avg.

A smoothed average spectral amplitude parameter Spec_sm and the spectral difference parameter Diff_sm.

6. According to the average spectral amplitude parameter Spec_sm, the spectral difference parameter Diff_sm, and the difference-to-amplitude ratio parameter Diff_ratio, determine whether the initial pitch period $T_{op}$ is correct, and determine whether to change a determining flag T_flag.

For example, when the spectral difference parameter Diff_sm is less than a first difference parameter threshold Diff_thr1, the average spectral amplitude parameter Spec_sm is less than a first spectral amplitude parameter threshold Spec_thr1, and the difference-to-amplitude ratio parameter Diff_ratio is less than a first ratio factor parameter threshold ratio_thr1, it is determined that the correctness flag T_flag is 1, and it is determined that the initial pitch period is incorrect according to the correctness flag. For another example, when the spectral difference parameter Diff_sm is greater than a second difference parameter threshold Diff_thr2, the average spectral amplitude parameter Spec_sm is greater than a second spectral amplitude parameter threshold Spec_thr2, and the difference-to-amplitude ratio parameter Diff_ratio is greater than a second ratio factor parameter threshold ratio_thr2, it is determined that the correctness flag T_flag is 0, and it is determined that the initial pitch period is correct according to the correctness flag. If not all correctness determining conditions are met and not all incorrectness determining conditions are met, an original flag T_flag remains unchanged.

It should be understood that, the first difference parameter threshold Diff_thr1, the first spectral amplitude parameter threshold Spec_thr1, the first ratio factor parameter threshold ratio_thr1, the second difference parameter threshold Diff_thr2, the second spectral amplitude parameter threshold Spec_thr2, and the second ratio factor parameter threshold ratio_thr2 may be selected according to a requirement.

For an incorrect initial pitch period detected according to the foregoing method, fine detection may be performed on the foregoing detection result, so as to avoid a detection error of the foregoing method.

In addition, energy in a low-frequency range may be further detected, so as to further detect the correctness of the initial pitch period. Short-pitch detection may be further performed on a detected incorrect pitch period.

7.1. Whether energy of the initial pitch period is very small in a low-frequency range may be further detected for the initial pitch period. When detected energy meets a low-frequency energy determining condition, the short-pitch detection is performed. The low-frequency energy determining condition specifies two low-frequency energy relative values that represent that the low-frequency energy is relatively very small and the low-frequency energy is relatively large. Therefore, when the detected energy meets that the low-frequency energy is relatively very small, the correctness flag T_flag is set to 1; and when the detected energy meets that the low-frequency energy is relatively large, the correctness flag T_flag is set to 0. If the detected energy does not meet the low-frequency energy determining condition, the original flag T_flag remains unchanged. When the correctness flag T_flag is set to 1, the short-pitch detection is performed. In addition to specifying the low-frequency energy relative values, the low-frequency energy determining condition may also specify another combination of conditions to increase robustness of low-frequency energy determining condition.

For example, two frequency bins f_low1 and f_low2 are first set, energy being energy 1 and energy 2 of initial pitch periods in ranges between 0 and f_low1 and between f_low1 and f_low2 is calculated separately, and then, an energy difference between the energy1 and the energy2 is calculated: energy_diff=energy2−energy1. Further, the energy difference may be weighted, and a weighting factor may be a voicing degree factor voice_factor, that is, energy_diff_w=energy_diff*voice_factor. Generally, a weighted energy difference may be further smoothed, and a result of the smoothing is compared with a preset threshold to determine whether the energy of the initial pitch period in the low-frequency range is missing.

Alternatively, the foregoing algorithm is simplified, so that low-frequency energy of the initial pitch period in a range is directly obtained, then, the low-frequency energy is weighted and smoothed, and a result of the smoothing is compared with a preset threshold.

7.2. Perform the short-pitch detection, and determine, according to the correctness flag T_flag or according to the correctness flag T_flag in combination with another condition, whether to replace the initial pitch period $T_{op}$ with a result of the short-pitch detection. Alternatively, before the short-pitch period is performed, whether it is necessary to perform the short-pitch detection may be first determined according to the correctness flag T_flag or according to the correctness flag T_flag in combination with another condition.

The short-pitch detection may be performed in the frequency domain, or may be performed in the time domain.

For example, in the time domain a detection range of the pitch period is generally from 34 to 231, to perform the short-pitch detection is to search for a pitch period with a range less than 34, and a method used may be a time domain autocorrelation function method: $R(T)=MAX\{R(t), t<34\}$; if R(T) is greater than a preset threshold or an autocorrelation value that is corresponding to the initial pitch period, and when T_flag is 1 (another condition may also be added here), T may be considered as a detected short-pitch period.

In addition to the short-pitch detection, multiplied-frequency detection may also be performed. If the correctness flag T_flag is 1, it is indicated that the initial pitch period $T_{op}$ is incorrect, and therefore the multiplied-frequency pitch detection may be performed at a multiplied-frequency location of the initial pitch period $T_{op}$, where a multiplied-frequency pitch period may be an integral multiple of the initial pitch period $T_{op}$, or may be a fractional multiple of the initial pitch period $T_{op}$.

For step 7.1 and step 7.2, only step 7.2 may be performed to simplify the process of the fine detection.

8. All of the steps 1 to 7.2 are performed for a current frame. After the current frame is processed, a next frame needs to be processed. Therefore, for the next frame, an average spectral amplitude parameter Spec_sm and a spectral difference parameter Diff_sm of the current frame are used a parameter Spec_sm_pre being a weighted and smoothed value of an average spectral amplitude of a previous frame and a parameter Diff_sm_pre being a weighted and smoothed value of a spectral difference of the previous frame, and are temporarily stored to implement parameter smoothing of the next frame.

Therefore, it can be learned that in this embodiment of the present invention, after an initial pitch period is obtained during open-loop detection, correctness of the initial pitch period is detected in a frequency domain, and if it is detected that the initial pitch period is incorrect, the initial pitch period is corrected using fine detection, so as to ensure the correctness of the initial pitch period. In the method for detecting correctness of an initial pitch period, a spectral difference parameter, an average spectral amplitude (or spectral energy) parameter and a difference-to-amplitude ratio parameter of a predetermined quantity of frequency bins on two sides of a pitch frequency bin need to be extracted. Because complexity of extracting these parameters is low, this embodiment of the present invention can ensure that a pitch period with relatively high correctness is output based on a less complex algorithm. In conclusion, the method for detecting correctness of a pitch period according to this embodiment of the present invention can improve, based on a relatively less complex algorithm, accuracy of detecting correctness of a pitch period.

Figure 2:
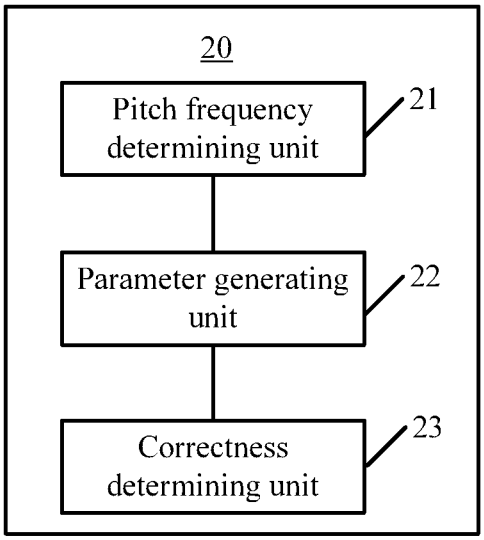
FIG. 2 is a schematic structural diagram of an apparatus for detecting correctness of a pitch period according to an embodiment of the present invention.
Figure 3:
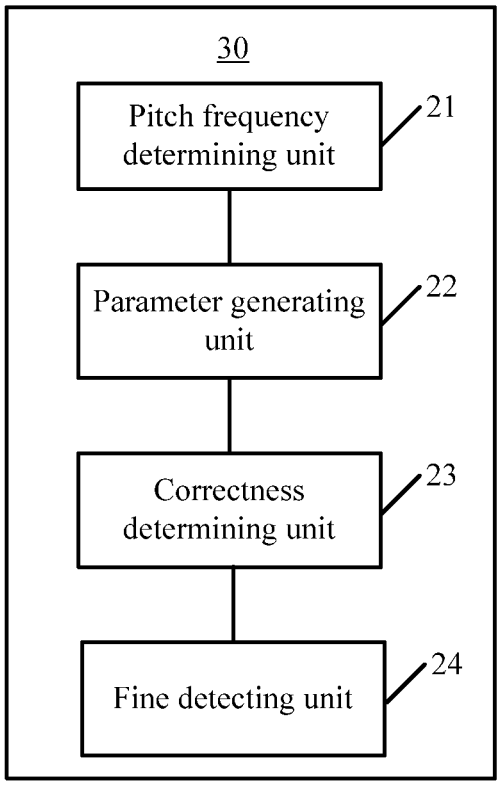
FIG. 3 is a schematic structural diagram of an apparatus for detecting correctness of a pitch period according to an embodiment of the present invention.
Figure 4:
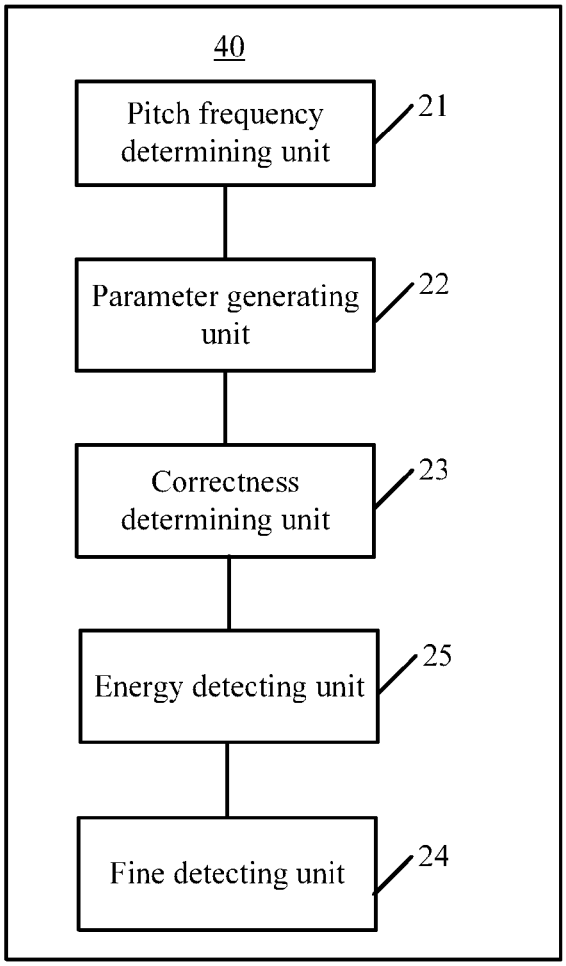
FIG. 4 is a schematic structural diagram of an apparatus for detecting correctness of a pitch period according to an embodiment of the present invention.

The following describes apparatuses for detecting correctness of a pitch period according to embodiments of the present invention in detail with reference to FIG. 2 to FIG. 4.

In FIG. 2, an apparatus 20 for detecting correctness of a pitch period includes a pitch frequency bin determining unit 21, a parameter generating unit 22, and a correctness determining unit 23.

The pitch frequency bin determining unit 21 is configured to determine, according to an initial pitch period of an input signal in a time domain, a pitch frequency bin of the input signal, where the initial pitch period is obtained by performing open-loop detection on the input signal. The pitch frequency bin determining unit 21 determines the pitch frequency bin based on the following manner: the pitch frequency bin of the input signal is reversely proportional to the initial pitch period, and is directly proportional to a quantity of points of an FFT performed on the input signal.

The parameter generating unit 22 is configured to determine, based on an amplitude spectrum of the input signal in a frequency domain, a pitch period correctness decision parameter, associated with the pitch frequency bin, of the input signal. The pitch period correctness decision parameter generated by the parameter generating unit 22 includes a spectral difference parameter Diff_sm, an average spectral amplitude parameter Spec_sm, and a difference-to-amplitude ratio parameter Diff_ratio. The spectral difference parameter Diff_sm is a sum Diff_sum of spectral differences of a predetermined quantity of frequency bins on two sides of the pitch frequency bin or a weighted and smoothed value of the sum Diff_sum of the spectral differences of the predetermined quantity of frequency bins on two sides of the pitch frequency bin. The average spectral amplitude parameter Spec_sm is an average Spec_avg of spectral amplitudes of the predetermined quantity of frequency bins on the two sides of the pitch frequency bin or a weighted and smoothed value of the average Spec_avg of the spectral amplitudes of the predetermined quantity of frequency bins on the two sides of the pitch frequency bin. The difference-to-amplitude ratio parameter Diff_ratio is a ratio of the sum Diff_sum of the spectral differences of the predetermined quantity of frequency bins on the two sides of the pitch frequency bin to the average Spec_avg of the spectral amplitudes of the predetermined quantity of frequency bins on the two sides of the pitch frequency bin.

The correctness determining unit 23 is configured to determine correctness of the initial pitch period according to the pitch period correctness decision parameter.

When the correctness determining unit 23 determines that the pitch period correctness decision parameter meets a correctness determining condition, the correctness determining unit 23 determines that the initial pitch period is correct; or, when the correctness determining unit 23 determines that the pitch period correctness decision parameter meets an incorrectness determining condition, the correctness determining unit 23 determines that the initial pitch period is incorrect.

Herein, the incorrectness determining condition meets at least one of the following: the spectral difference parameter Diff_sm is less than or equal to a first difference parameter threshold, the average spectral amplitude parameter Spec_sm is less than or equal to a first spectral amplitude parameter threshold, and the difference-to-amplitude ratio parameter Diff_ratio is less than or equal to a first ratio factor parameter threshold.

The correctness determining condition meets at least one of the following: the spectral difference parameter Diff_sm is greater than a second difference parameter threshold, the average spectral amplitude parameter Spec_sm is greater than a second spectral amplitude parameter threshold, and the difference-to-amplitude ratio parameter Diff_ratio is greater than a second ratio factor parameter threshold.

Optionally, as shown in FIG. 3, compared with the apparatus 20, an apparatus 30 for detecting correctness of a pitch period further includes a fine detecting unit 24 configured to, when it is detected that the initial pitch period is incorrect during the detecting, according to the pitch period correctness decision parameter, the correctness of the initial pitch period, perform fine detection on the input signal.

Optionally, as shown in FIG. 4, compared with the apparatus 30, an apparatus 40 for detecting correctness of a pitch period may further include an energy detecting unit 25 configured to, when an incorrect initial pitch period is detected during the detecting, according to the pitch period correctness decision parameter, the correctness of the initial pitch period, detect energy of the initial pitch period in a low-frequency range. Then, the fine detecting unit 24 performs short-pitch detection on the input signal when the energy detecting unit 25 detects that the energy meets a low-frequency energy determining condition.

Therefore, it can be learned that the apparatus for detecting correctness of a pitch period according to this embodiment of the present invention can improve, based on a relatively less complex algorithm, accuracy of detecting correctness of a pitch period.

Figure 5:
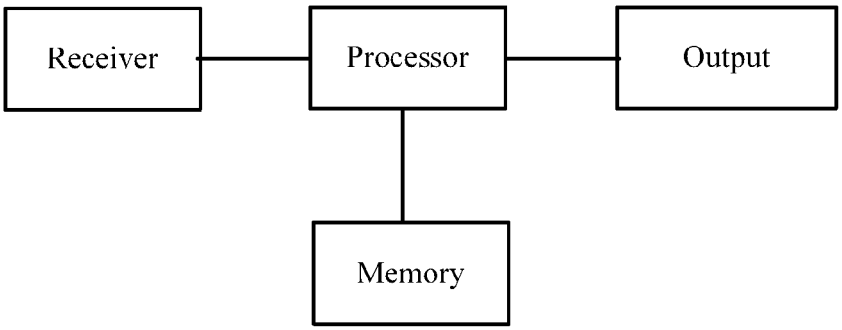
FIG. 5 is a schematic structural diagram of an apparatus for detecting correctness of a pitch period according to an embodiment of the present invention.

Referring to FIG. 5, in another embodiment, an apparatus for detecting correctness of a pitch period includes a receiver configured to receive an input signal; and a processor configured to determine a pitch frequency bin of the input signal according to an initial pitch period of the input signal in a time domain, where the initial pitch period is obtained by performing open-loop detection on the input signal; determine, based on an amplitude spectrum of the input signal in a frequency domain, a pitch period correctness decision parameter, associated with the pitch frequency bin, of the input signal; and determine correctness of the initial pitch period according to the pitch period correctness decision parameter.

It should be understood that, the processor may implement each step in the foregoing method embodiments.

A person of ordinary skill in the art may be aware that, in combination with the examples described in the embodiments disclosed in this specification, units and algorithm steps may be implemented by electronic hardware or a combination of computer software and electronic hardware. Whether the functions are performed by hardware or software depends on particular applications and design constraint conditions of the technical solutions. A person skilled in the art may use different methods to implement the described functions for each particular application, but it should not be considered that the implementation goes beyond the scope of the present invention.

It may be clearly understood by a person skilled in the art that, for the purpose of convenient and brief description, for a detailed working process of the foregoing system, apparatus, and unit, reference may be made to a corresponding process in the foregoing method embodiments, and details are not described herein again.

In the several embodiments provided in the present application, it should be understood that the disclosed system, apparatus, and method may be implemented in other manners. For example, the described apparatus embodiment is merely exemplary. For example, the unit division is merely logical function division and may be other division in actual implementation. For example, a plurality of units or components may be combined or integrated into another system, or some features may be ignored or not performed. In addition, the displayed or discussed mutual couplings or direct couplings or communication connections may be implemented through some interfaces. The indirect couplings or communication connections between the apparatuses or units may be implemented in electronic, mechanical, or other forms.

The units described as separate parts may or may not be physically separate, and parts displayed as units may or may not be physical units, may be located in one position, or may be distributed on a plurality of network units. A part or all of the units may be selected according to actual needs to achieve the objectives of the solutions of the embodiments.

In addition, functional units in the embodiments of the present invention may be integrated into one processing unit, or each of the units may exist alone physically, or two or more units are integrated into one unit.

When the functions are implemented in a form of a software functional unit and sold or used as an independent product, the functions may be stored in a computer-readable storage medium. Based on such an understanding, the technical solutions of the present invention essentially, or the part contributing to the prior art, or a part of the technical solutions may be implemented in a form of a software product. The software product is stored in a storage medium, and includes several instructions for instructing a computer device (which may be a personal computer, a server, or a network device) to perform all or a part of the steps of the methods described in the embodiments of the present invention. The foregoing storage medium includes any medium that can store program code, such as a universal serial bus (USB) flash drive, a removable hard disk, a read-only memory (ROM), a random access memory (RAM), a magnetic disk, or an optical disc.

The foregoing descriptions are merely specific implementation manners of the present invention, but are not intended to limit the protection scope of the present invention. Any variation or replacement readily figured out by a person skilled in the art within the technical scope disclosed in the present invention shall fall within the protection scope of the present invention. Therefore, the protection scope of the present invention shall be subject to the protection scope of the claims.

What is claimed is:

1. A method for detecting correctness of a pitch period, comprising:

determining, by a processor and according to an initial pitch period of an input signal comprising a speech signal or an audio signal in a time domain, a pitch frequency bin of the input signal, wherein the initial pitch period is obtained by performing open-loop detection on the input signal;

determining, by the processor and based on an amplitude spectrum of the input signal in a frequency domain, a pitch period correctness decision parameter of the input signal associated with the pitch frequency bin; and determining, by the processor, correctness of the initial pitch period according to the pitch period correctness decision parameter, wherein the pitch period correctness decision parameter comprises a spectral difference parameter, an average spectral amplitude parameter, and a difference-to-amplitude ratio parameter, wherein the spectral difference parameter is a weighted and smoothed value of a sum of spectral differences of predetermined quantity of frequency bins on two sides of the pitch frequency bin, wherein the average spectral amplitude parameter is a weighted and smoothed value of an average of spectral amplitudes of the predetermined quantity of frequency bins on the two sides of the pitch frequency bin, and wherein the difference-to-amplitude ratio parameter is a ratio of the sum of the spectral differences of the predetermined quantity of frequency bins on the two sides of the pitch frequency bin to the average of the spectral amplitudes of the predetermined quantity of frequency bins on the two sides of the pitch frequency bin.

2. The method according to claim 1, wherein determining the correctness of the initial pitch period according to the pitch period correctness decision parameter comprises:

determining that the initial pitch period is correct when the pitch period correctness decision parameter meets a correctness determining condition; and determining that the initial pitch period is incorrect when the pitch period correctness decision parameter meets an incorrectness determining condition.

3. The method according to claim 2, wherein the correctness determining condition meets at least one of the following conditions:

the spectral difference parameter is greater than a second difference parameter threshold;

the average spectral amplitude parameter is greater than a second spectral amplitude parameter threshold; and the difference-to-amplitude ratio parameter is greater than a second ratio factor parameter threshold, and wherein the incorrectness determining condition meets at least one of the following conditions:

the spectral difference parameter is less than a first difference parameter threshold;

the average spectral amplitude parameter is less than a first spectral amplitude parameter threshold; and the difference-to-amplitude ratio parameter is less than a first ratio factor parameter threshold.

4. The method according to claim 1, wherein the method further comprises performing, by the processor, fine detection on the input signal when it is detected that the initial pitch period is incorrect during the detecting, according to the pitch period correctness decision parameter, the correctness of the initial pitch period.

5. The method according to claim 1, wherein, after the determining correctness of the initial pitch period according to the pitch period correctness decision parameter, the method further comprises:

detecting, by the processor, energy in a low-frequency range; and performing, by the processor, short-pitch detection on the input signal when the energy meets a low-frequency energy determining condition.

6. The method according to claim 1, wherein the pitch frequency bin of the input signal is reversely proportional to the initial pitch period and is directly proportional to a quantity of points of a fast Fourier transform performed on the input signal.

7. An apparatus for detecting correctness of a pitch period comprising:

a memory comprising instructions; and one or more processors in communication with the memory, wherein the one or more processors are configured to execute the instructions to:

determine, according to an initial pitch period of an input signal comprising a speech signal or an audio signal in a time domain, a pitch frequency bin of the input signal, wherein the initial pitch period is obtained by performing open-loop detection on the input signal;

determine, based on an amplitude spectrum of the input signal in a frequency domain, a pitch period correctness decision parameter of the input signal associated with the pitch frequency bin; and determine correctness of the initial pitch period according to the pitch period correctness decision parameter, wherein the pitch period correctness decision parameter comprises a spectral difference parameter, an average spectral amplitude parameter, and a difference-to-amplitude ratio parameter, wherein the spectral difference parameter is a weighted and smoothed value of a sum of spectral differences of predetermined quantity of frequency bins on two sides of the pitch frequency bin, wherein the average spectral amplitude parameter is a weighted and smoothed value of an average of spectral amplitudes of the predetermined quantity of frequency bins on the two sides of the pitch frequency bin, and wherein the difference-to-amplitude ratio parameter is a ratio of the sum of the spectral differences of the predetermined quantity of frequency bins on the two sides of the pitch frequency bin to the average of the spectral amplitudes of the predetermined quantity of frequency bins on the two sides of the pitch frequency bin.

8. The apparatus according to claim 7, wherein the processor further executes instructions to perform fine detection on the input signal, when it is detected that the initial pitch period is incorrect during the detecting, according to the pitch period correctness decision parameter, the correctness of the initial pitch period.

9. The apparatus according to claim 7, wherein the processor further executes instructions to:

detect energy of the initial pitch period in a low-frequency range, when an incorrect initial pitch period is detected during the detecting, according to the pitch period correctness decision parameter, the correctness of the initial pitch period; and perform short-pitch detection on the input signal when the energy meets a low-frequency energy determining condition.

10. The apparatus according to claim 7, wherein the pitch frequency bin of the input signal is reversely proportional to the initial pitch period and is directly proportional to a quantity of points of a fast Fourier transform performed on the input signal.

11. The apparatus according to claim 7, wherein to determine correctness of the initial pitch period according to the pitch period correctness decision parameter, the processor executes instructions to:

determine that the initial pitch period is correct when it is determined that the pitch period correctness decision parameter meets a correctness determining condition; and determine that the initial pitch period is incorrect when it is determined that the pitch period correctness decision parameter meets an incorrectness determining condition.

12. An apparatus for detecting correctness of a pitch period comprising:

a memory comprising instructions; and one or more processors in communication with the memory, wherein the one or more processors are configured to execute the instructions to:

determine, according to an initial pitch period of an input signal comprising a speech signal or an audio signal in a time domain, a pitch frequency bin of the input signal, wherein the initial pitch period is obtained by performing open-loop detection on the input signal;

determine, based on an amplitude spectrum of the input signal in a frequency domain, a pitch period correctness decision parameter of the input signal associated with the pitch frequency bin; and determine correctness of the initial pitch period according to the pitch period correctness decision parameter, wherein the pitch period correctness decision parameter comprises a spectral difference parameter, an average spectral amplitude parameter, and a difference-to-amplitude ratio parameter, wherein the spectral difference parameter is a sum of spectral differences of a predetermined quantity of frequency bins on two sides of the pitch frequency bin, wherein the average spectral amplitude parameter is an average of spectral amplitudes of the predetermined quantity of frequency bins on the two sides of the pitch frequency bin, and wherein the difference-to-amplitude ratio parameter is a ratio of the sum of the spectral differences of the predetermined quantity of frequency bins on the two sides of the pitch frequency bin to the average of the spectral amplitudes of the predetermined quantity of frequency bins on the two sides of the pitch frequency bin.

13. The apparatus according to claim 12, wherein to determine correctness of the initial pitch period according to the pitch period correctness decision parameter, the processor executes instructions to:

determine that the initial pitch period is correct when it is determined that the pitch period correctness decision parameter meets a correctness determining condition; and determine that the initial pitch period is incorrect when it is determined that the pitch period correctness decision parameter meets an incorrectness determining condition.

14. The apparatus according to claim 13, wherein the correctness determining condition meets at least one of the following conditions:

the spectral difference parameter is greater than a second difference parameter threshold;

the average spectral amplitude parameter is greater than a second spectral amplitude parameter threshold; and the difference-to-amplitude ratio parameter is greater than a second ratio factor parameter threshold, and wherein the incorrectness determining condition meets at least one of the following conditions:

the spectral difference parameter is less than a first difference parameter threshold;

the average spectral amplitude parameter is less than a first spectral amplitude parameter threshold; and the difference-to-amplitude ratio parameter is less than a first ratio factor parameter threshold.

15. The apparatus according to claim 13, wherein the correctness determining condition meets at least one of the following conditions:

the spectral difference parameter is greater than a second difference parameter threshold;

the average spectral amplitude parameter is greater than a second spectral amplitude parameter threshold; and the difference-to-amplitude ratio parameter is greater than a second ratio factor parameter threshold, and wherein the incorrectness determining condition meets at least one of the following conditions:

the spectral difference parameter is less than a first difference parameter threshold;

the average spectral amplitude parameter is less than a first spectral amplitude parameter threshold; and the difference-to-amplitude ratio parameter is less than a first ratio factor parameter threshold.

* * * * *